US006428404B2

(12) United States Patent
Walker et al.

(10) Patent No.: US 6,428,404 B2
(45) **Date of Patent: *Aug. 6, 2002**

(54) WEB-FORMAT PLANARIZING MACHINES AND METHODS FOR PLANARIZING MICROELECTRONIC SUBSTRATE ASSEMBLIES

(75) Inventors: Michael A. Walker, Boise; Scott E. Moore, Meridian, both of ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/957,112

(22) Filed: Sep. 19, 2001

Related U.S. Application Data

(60) Continuation of application No. 09/907,834, filed on Jul. 17, 2001, which is a division of application No. 09/385,985, filed on Aug. 30, 1999, now Pat. No. 6,261,163.

(51) Int. Cl.[7] ..... B24B 21/00
(52) U.S. Cl. ..... 451/311; 451/303
(58) Field of Search ..... 451/303, 311, 451/296, 41; 407/101, 110, 111

(56) References Cited

U.S. PATENT DOCUMENTS

| | | | | |
|---|---|---|---|---|
| 4,945,683 | A | 8/1990 | Phillips | |
| 5,210,978 | A | 5/1993 | Philips | |
| 5,692,947 | A | 12/1997 | Talieh et al. | |
| 5,961,372 | A | 10/1999 | Shendon | |
| 6,000,997 | A | 12/1999 | Kao et al. | |
| 6,184,139 | B1 | 2/2001 | Adams et al. | |
| 6,261,163 | B1 * | 7/2001 | Walker et al. | 451/311 |
| 6,306,014 | B1 | 10/2001 | Walker et al. | |

* cited by examiner

*Primary Examiner*—Timothy V. Eley
*Assistant Examiner*—Dung Van Nguyen
(74) *Attorney, Agent, or Firm*—Dorsey & Whitney LLP

(57) ABSTRACT

Methods and machines for planarizing microelectronic substrate assemblies using mechanical and/or chemical-mechanical planarizing processes. One machine in accordance with an embodiment of the invention includes a table having a support surface with a planarizing zone, an elongated polishing pad configured to move across the support surface of the table along a pad travel path, and a pad advancing mechanism coupled to the pad. The elongated pad can have a length along an elongated dimension extending along the pad travel path, an elongated first edge, an elongated second edge opposite the first edge, an elongated first side region extending along the first edge, an elongated second side region extending along the second edge, and an elongated medial region having a width between the first and second side regions. The pad advancing mechanism can include a first roller about which an unused portion of the pad is wrapped and a second roller about which a used portion of the pad is wrapped. The planarizing machine can further include a carrier assembly having a head and a drive system to translate the substrate assembly across an active section of the polishing pad in the planarizing zone. The planarizing machine further includes a pad tensioning system between the planarizing zone of the table and either the first roller or the second roller. The tensioning system, for example, can have a pneumatic or mechanical stretching assembly configured to push or pull the medial region of the pad more than the first and second side regions to compensate for the smaller diameter of the used portion of the pad wrapped around the second roller.

28 Claims, 14 Drawing Sheets

WEB-FORMAT PLANARIZING MACHINES AND METHODS FOR PLANARIZING MICROELECTRONIC SUBSTRATE ASSEMBLIES

CROSS-REFERENCE TO RELATED APPLICATIONS

This application is a continuation of pending U.S. patent application Ser. No. 09/907,834, filed Jul. 17, 2001, which is a divisional of U.S. patent application Ser. No. 09/385,985, filed Aug. 30, 1999, now issued as U.S. Pat. No. 6,261,163.

TECHNICAL FIELD

The present invention relates to methods and apparatuses for planarizing microelectronic substrate assemblies. More particularly, the present invention relates to web-format planarizing machines that stretch a medial region of the polishing pad more than side regions to compensate for uneven wrapping of a used portion of the polishing pad around a take-up roller.

BACKGROUND OF THE INVENTION

Mechanical and chemical-mechanical planarizing processes (collectively "CMP") are used in the manufacturing of electronic devices for forming a flat surface on semiconductor wafers, field emission displays and many other microelectronic substrate assemblies. CMP processes generally remove material from a substrate assembly to create a highly planar surface at a precise elevation in the layers of material on the substrate assembly.

FIG. 1 is a schematic isometric view of a web-format planarizing machine 10 for planarizing a microelectronic substrate assembly 12. The planarizing machine 10 has a table 11 with a rigid panel or plate to provide a flat, solid support surface 13 for supporting a portion of a web-format planarizing pad 40 in a planarizing zone "A." The planarizing machine 10 also has a pad advancing mechanism including a plurality of rollers to guide, position, and hold the web-format pad 40 over the support surface 13. The pad advancing mechanism generally includes a supply roller 20, first and second idler rollers 21*a* and 21*b*, first and second guide rollers 22*a* and 22*b*, and a take-up roller 23. As explained below, a motor (not shown) drives the take-up roller 23 to advance the pad 40 across the support surface 13 along a travel axis T—T. The motor can also drive the supply roller 20. The first idler roller 21*a* and the first guide roller 22*a* press an operative portion of the pad against the support surface 13 to hold the pad 40 stationary during operation.

The planarizing machine 10 also has a carrier assembly 30 to translate the substrate assembly 12 across the pad 40. In one embodiment, the carrier assembly 30 has a head 32 to pick up, hold and release the substrate assembly 12 at appropriate stages of the planarizing process. The carrier assembly 30 also has a support gantry 34 and a drive assembly 35 that can move along the gantry 34. The drive assembly 35 has an actuator 36, a drive shaft 37 coupled to the actuator 36, and an arm 38 projecting from the drive shaft 37. The arm 38 carries the head 32 via another shaft 39. The actuator 36 orbits the head 32 about an axis B—B to move the substrate assembly 12 across the pad 40.

The polishing pad 40 may be a non-abrasive polymeric pad (e.g., polyurethane), or it may be a fixed-abrasive polishing pad in which abrasive particles are fixedly dispersed in a resin or another type of suspension medium. A planarizing fluid 50 flows from a plurality of nozzles 49 during planarization of the substrate assembly 12. The planarizing fluid 50 may be a conventional CMP slurry with abrasive particles and chemicals that etch and/or oxidize the surface of the substrate assembly 12, or the planarizing fluid 50 may be a "clean" non-abrasive planarizing solution without abrasive particles. In most CMP applications, abrasive slurries with abrasive particles are used on non-abrasive polishing pads, and non-abrasive clean solutions without abrasive particles are used on fixed-abrasive polishing pads.

In the operation of the planarizing machine 10, the pad 40 moves across the support surface 13 along the pad travel path T—T either during or between planarizing cycles to change the particular portion of the polishing pad 40 in the planarizing zone A. For example, the supply and take-up rollers 20 and 23 can drive the polishing pad 40 between planarizing cycles such that a point P moves incrementally across the support surface 13 to a number of intermediate locations $I_1$, $I_2$, etc. Alternatively, the rollers 20 and 23 may drive the polishing pad 40 between planarizing cycles such that the point P moves all the way across the support surface 13 to completely remove a used portion of the pad 40 from the planarizing zone A. The rollers may also continuously drive the polishing pad 40 at a slow rate during a planarizing cycle such that the point P moves continuously across the support surface 13. Thus, the polishing pad 40 should be free to move axially over the length of the support surface 13 along the pad travel path T—T.

CMP processes should consistently and accurately produce a uniform, planar surface on substrate assemblies to enable circuit and device patterns to be formed with photolithography techniques. As the density of integrated circuits increases, it is often necessary to accurately focus the critical dimensions of the photo-patterns to within a tolerance of approximately 0.1–0.2 $\mu$m. Focusing photo-patterns to such small tolerances, however, is difficult when the planarized surfaces of substrate assemblies are not uniformly planar. Thus, to be effective, CMP processes should create highly uniform, planar is surfaces on substrate assemblies.

Although web-format planarizing machines show promising results, the polishing pad 40 may develop wrinkles in the planarizing zone A as more of the used portion of the pad wraps around the take-up roller 23. More specifically, the middle region of the polishing pad 40 wears more than the side regions because the substrate assembly 12 does not contact the side regions during planarization. The middle region of the used portion of the polishing pad 40 is accordingly thinner than the side regions, and the middle region of the portion of the pad 40 wrapped around the take-up roller 23 accordingly has a smaller diameter than the side regions. The torque applied to the take-up roller 23 thus exerts a non-uniform tension across the width of the pad 40 that causes the polishing pad 40 to wrinkle or slip during a planarizing cycle. Additionally, as the polishing pad is transferred from the supply roller 20 to the take-up roller 23, the torque applied to the take-up roller 23 must be continually adjusted to mitigate wrinkles and slippage in the middle portion of the polishing pad 40.

SUMMARY OF THE INVENTION

The present invention is directed toward methods and machines for planarizing microelectronic substrate assemblies in mechanical and/or chemical-mechanical planarizing processes. For the purposes of the present application, the term "planarizing" means both planarizing substrate assemblies to form a planar surface and polishing substrate assemblies to form a smooth surface.

One machine in accordance with an embodiment of the invention includes a table having a support surface with a planarizing zone, an elongated polishing pad configured to move across the support surface of the table along a pad travel path, and a pad advancing mechanism coupled to the pad. The elongated pad can have a length along an elongated dimension extending along the pad travel path. The length of the polishing pad, for example, is generally sufficient to extend across the table. The polishing pad further includes an elongated first edge, an elongated second edge opposite the first edge, an elongated first side region extending along the first edge, an elongated second side region extending along the second edge, and an elongated medial region having a width between the first and second side regions. The pad advancing mechanism can include a first roller about which an unused portion of the pad is wrapped and a second roller about which a used portion of the pad is wrapped. At least one of the first and second rollers is driven to advance the pad across the table along the pad travel path for positioning a desired active section of the pad in the planarizing zone.

The planarizing machine can further include a carrier assembly having a head and a drive system. The head is configured to hold a microelectronic substrate assembly, and the drive system moves the head to translate the substrate assembly across the active section of the polishing pad in the planarizing zone. In several embodiments of the invention, for example, a planarizing solution is deposited onto the polishing pad and the carrier assembly translates the substrate assembly across the active section of the polishing pad to remove material from the substrate assembly. The planarizing solution and/or the polishing pad can accordingly include abrasive particles to abrade the surface of the substrate assembly.

The planarizing machine further includes a pad tensioning system between the planarizing zone of the table and at least one of the first and second s rollers. The tensioning system, for example, can have a pneumatic or mechanical stretching assembly configured to push or pull the medial region of the pad more than the first and second side regions to compensate for the smaller diameter of the used portion of the pad wrapped around the second roller. The pad tensioning system, for example, can include an engagement member aligned with the medial region of the pad and an actuator connected to the engagement member. The engagement member generally extends transverse to the elongated dimension of the pad and has a length less than the width of the pad between the first and second edges. The actuator moves the engagement member to press the engagement member against the medial region of the pad so that the engagement member stretches the medial region of the pad more than the first and second side regions.

DETAILED DESCRIPTION OF THE INVENTION

The present invention relates to holding a web-format polishing pad on a planarizing machine in mechanical and/or chemical-mechanical planarization of semiconductor wafers, field emission displays and other microelectronic substrate assemblies. Many specific details of the invention are described below with reference to FIGS. 2–9 to provide a thorough understanding of several embodiments of the present invention. The invention, however, may have additional embodiments or can be practiced without several of the details described in the following embodiments.

Figure 1:
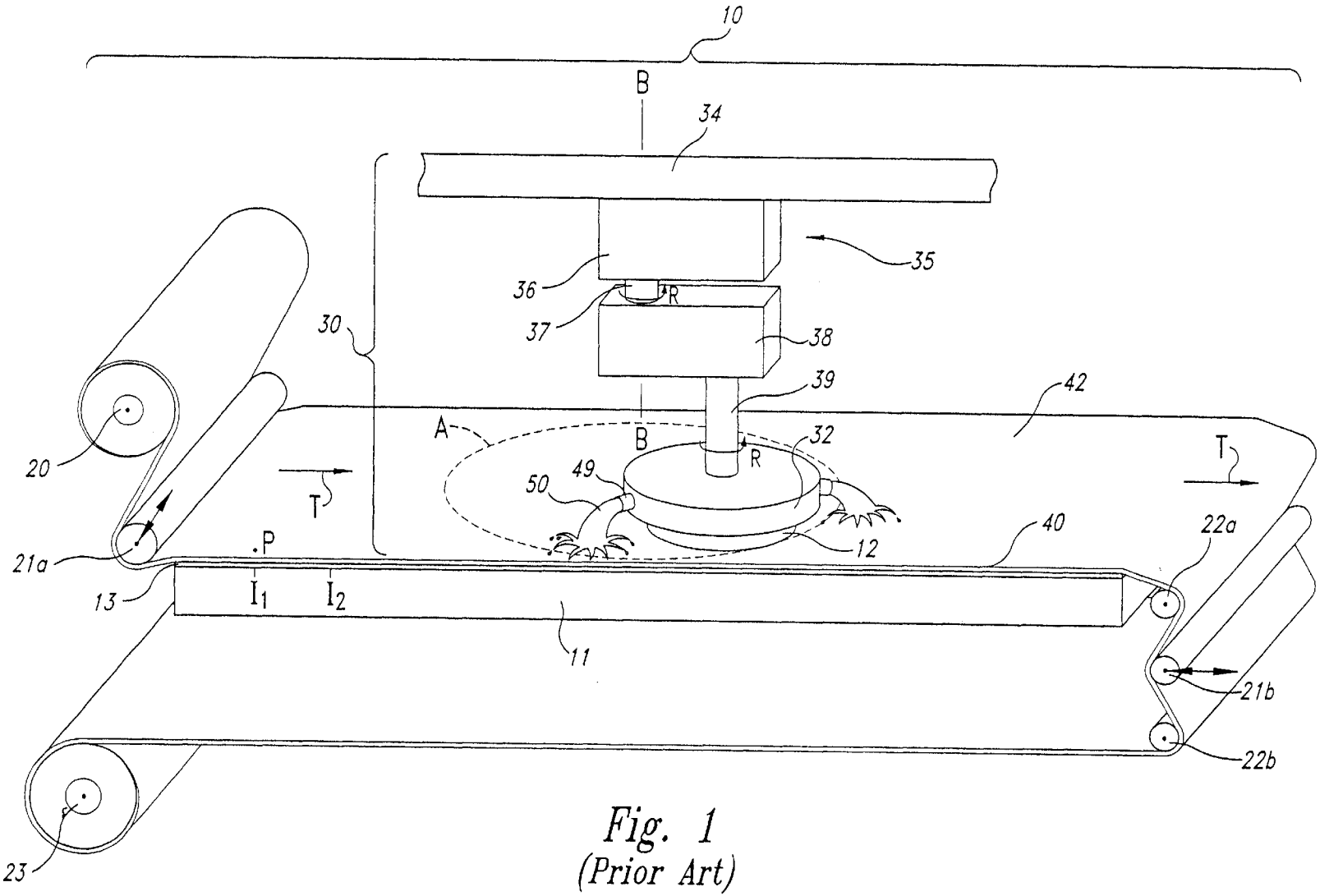
Fig. 1 (Prior Art)
FIG. 1 is a schematic isometric view of a web-format planarizing machine in accordance with the prior art.
Figure 2:
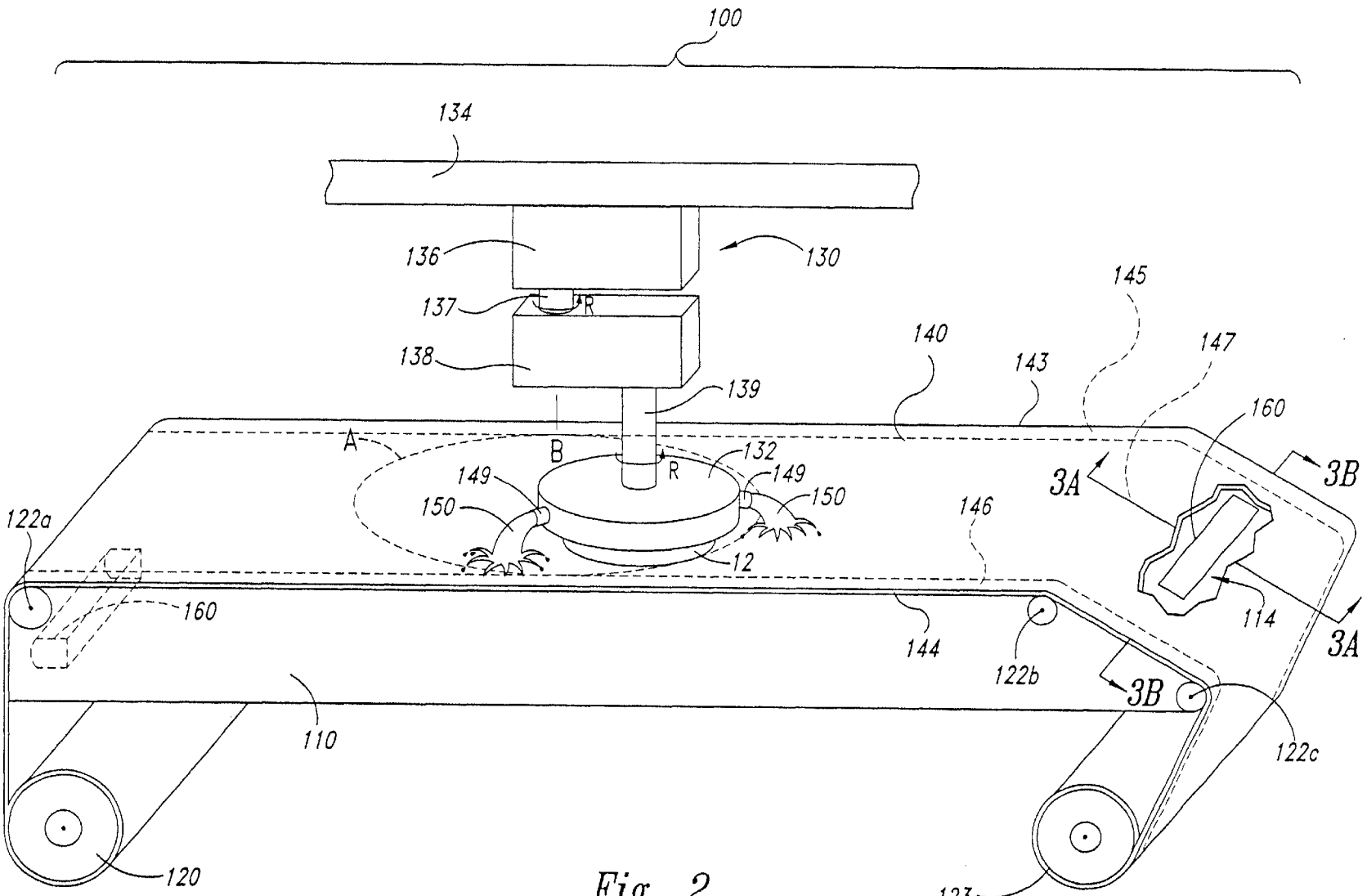
FIG. 2 is a schematic isometric view of a web-format planarizing machine for mechanical and/or chemical-mechanical planarization of microelectronic substrate assemblies in accordance with an embodiment of the invention.

FIG. 2 is a schematic isometric view of a web-format planarizing machine 100 for planarizing a microelectronic substrate assembly 12 in accordance with an embodiment of the invention. The planarizing machine 100 includes a table 110, a carrier assembly 130 over the table 110, and a polishing pad 140 on the table 110. The carrier assembly 130 and 4he polishing pad 140 can be substantially the same as those described above with reference to FIG. 1. The polishing pad 140 has an elongated first edge 143, an elongated second edge 144 opposite the first edge 143, an elongated first side region 145 extending along the first edge 143, an elongated second side region 146 extending along the second edge 144, and a medial region 147 between the first and second side regions 145 and 146. The polishing pad 140 is also coupled to a pad-advancing mechanism having a supply roller 120, a plurality of guide rollers 122*a*–*c*, and a take-up roller 123. The pad advancing mechanism shown in FIG. 2 can operate similar to the pad advancing mechanism described above with reference to FIG. 1.

The planarizing machine 100 also includes a pad tensioning system 160 (shown schematically in FIG. 2) at a tensioning site 114 on the table 110. The tensioning system 160 is generally positioned at a used portion of the polishing pad 140 between the planarizing zone A of the table 110 and the take-up roller 123 (shown in solid lines in FIG. 2), but the tensioning system 160 can be located at an unused portion of the polishing pad 140 between the planarizing zone A and the supply roller 120 (shown in broken lines in FIG. 2). The tensioning system 160 pulls or pushes a section of the medial region 147 of the pad 140 to compensate for the uneven tension exerted by the take-up roller 123 across the width of the polishing pad 140. Several particular embodiments of tensioning systems in accordance with the invention are explained in greater detail below with reference to FIGS. 3–9.

Figure 3A:
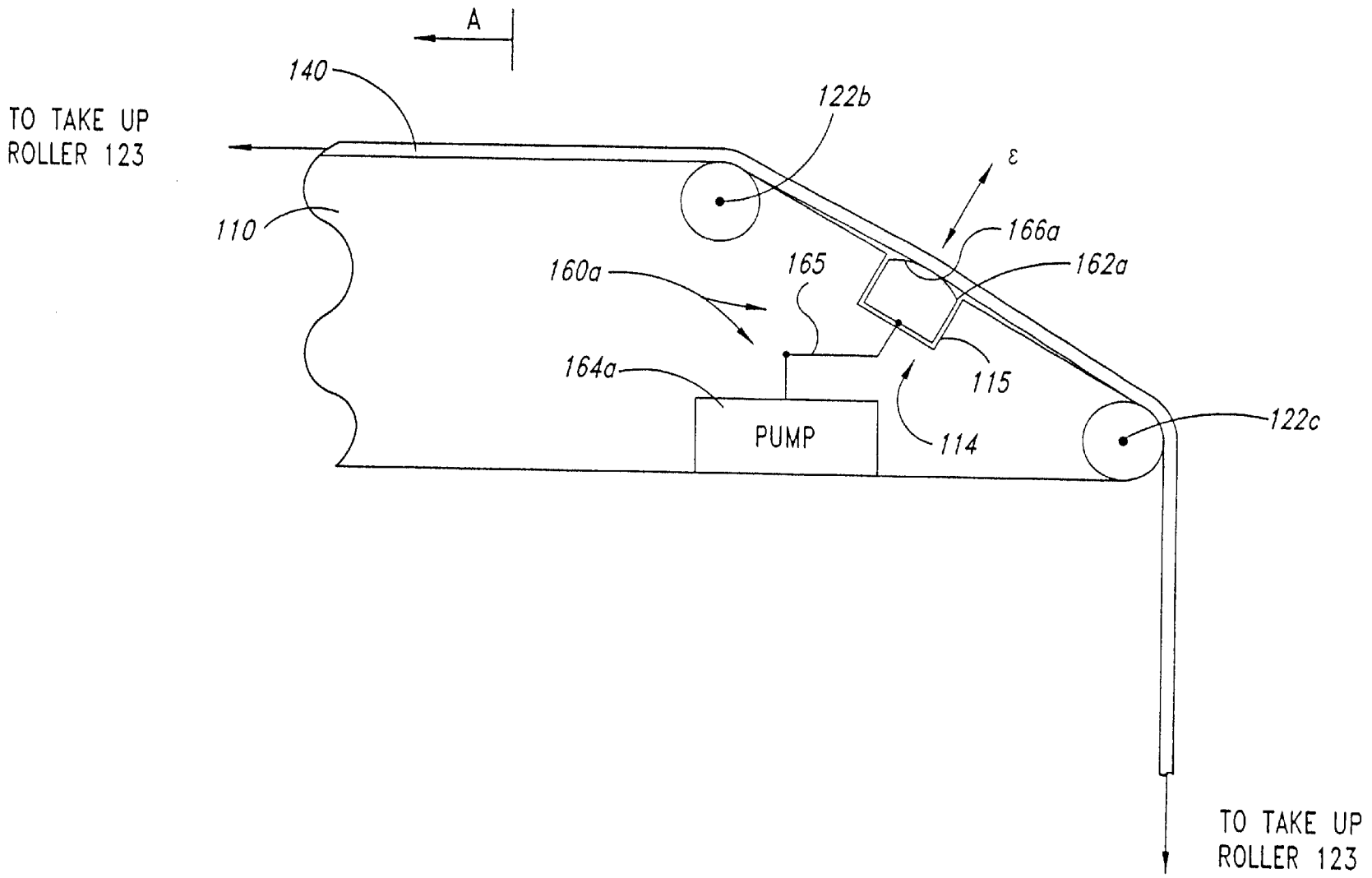
FIG. 3A is a cross-sectional side view schematically illustrating a tensioning system for a planarizing machine in accordance with an embodiment of the invention.
Figure 3B:
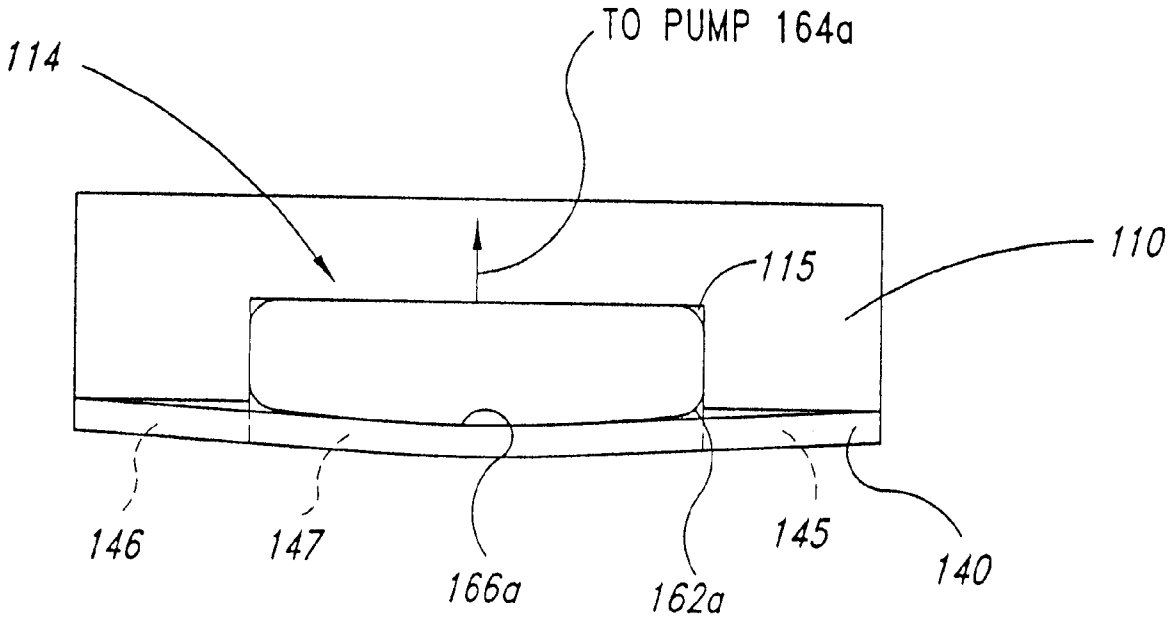
FIG. 3B is a cross-sectional top view of the tensioning system of FIG. 3A.

FIGS. 3A and 3B are schematic cross-sectional views of an embodiment of a tensioning system 160*a* for the planarizing machine 100 taken s along a side cross-section A—A (FIG. 2) and a top cross-section B—B (FIG. 2), respectively. In this embodiment, tensioning site 114 is between the planarizing zone A (FIG. 3A) and the second roller 123 (FIG. 3A). The tensioning site 114 can include an elongated recess 115 under a used section of the polishing pad 140. As best shown in FIG. 3B, the recess 115 is aligned with the medial region 147 of the pad 140 and extends width-wise relative to the width of the pad 140.

The tensioning system 160a includes an inflatable bladder 162*a* defining an engagement member and a fluid pump 164*a* defining an actuator. The bladder 162*a* generally conforms to the recess 115, and thus the bladder 162*a* is also aligned with the medial region 147 of the pad 140 and extends transversely to the edges 143/144 of the pad 140. The bladder 162*a* is coupled to the pump 164*a* by a fluid line 165. The fluid can be air, water or another suitable fluid for pneumatic or hydraulic pressurization of the bladder 162*a*. The pump 164*a* inflates or deflates the bladder 162*a* to move a contact surface 166*a* of the bladder 162*a* against a back side of the polishing pad 140. The inflatable bladder 162*a* accordingly stretches the medial region 147 of the pad 140 more than the side regions 145/146 to compensate for the lower tension applied to the medial region 147 by the take-up roller 123. It will be appreciated that the extent of deformation in the medial region 147 shown in FIGS. 3A and 3B is exaggerated greatly for illustrative purposes.

The tensioning system 160a can be continually adjusted to reduce or eliminate wrinkles in the medial region 147 of the pad 140. Referring to FIGS. 2–3B together, the pad advancing mechanism and the tensioning system 160*a* operate by releasing the supply roller 120 and driving the take-up roller 123 to move the pad 140 across the table 110. When a desired active portion of the pad 140 is in the planarizing zone A, a brake assembly (not shown) prevents the supply roller 120 from rotating further and a drive motor (not shown) applies a torque to the take-up roller 123. The torque applied by the drive motor is adjusted so that the take-up roller 123 exerts the desired tension on the side regions 145/146 of the pad 140. The tensioning system 160*a* is also activated to adjust the pressure of the fluid in the inflatable bladder 162*a*. The pressure in the inflatable bladder 162*a* is set to stretch the medial region 147 of the pad 140 according to the difference in diameter between the medial region 147 and the side regions 145/146 of the pad 140 wrapped around the take-up roller 123. For example, as more of the used portion of the pad 140 wraps around the take-up roller 123, the difference in tension increases between the side regions 145/146 and the medial region 147. The pump 164*a* accordingly increases the pressure in the inflatable bladder 162*a* as more of the used portion of the pad 140 wraps around the take-up roller 123 to increase the tension in the medial region 147. Therefore, the tensioning system 160*a* is expected to reduce or eliminate wrinkles in the medial region 147 of the pad 140 caused by the difference in wear between the medial region 147 and the side regions 145/146.

Figure 4A:
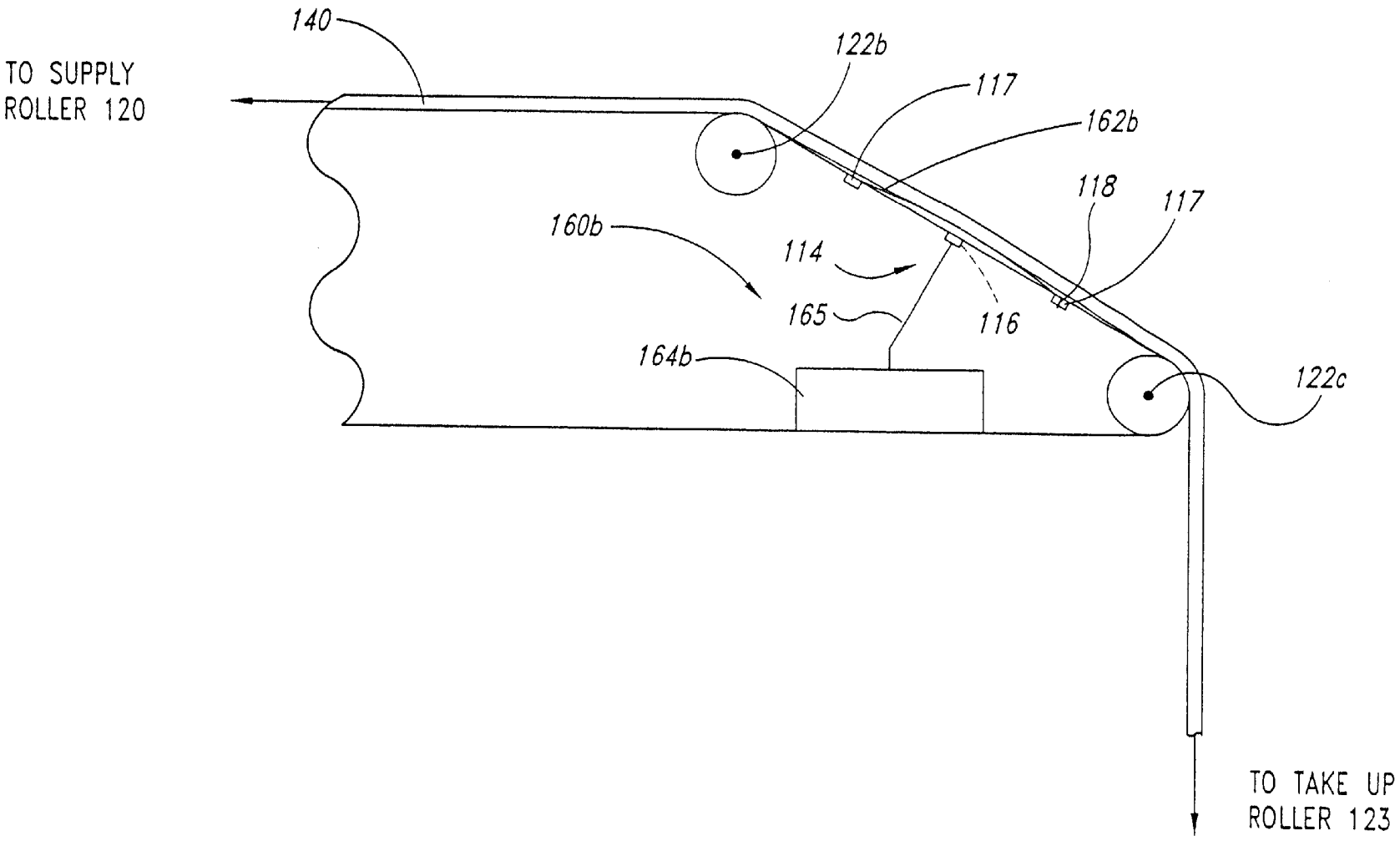
FIG. 4A is a cross-sectional side view schematically illustrating a tensioning system for a planarizing machine in accordance with another embodiment of the invention.
Figure 4B:
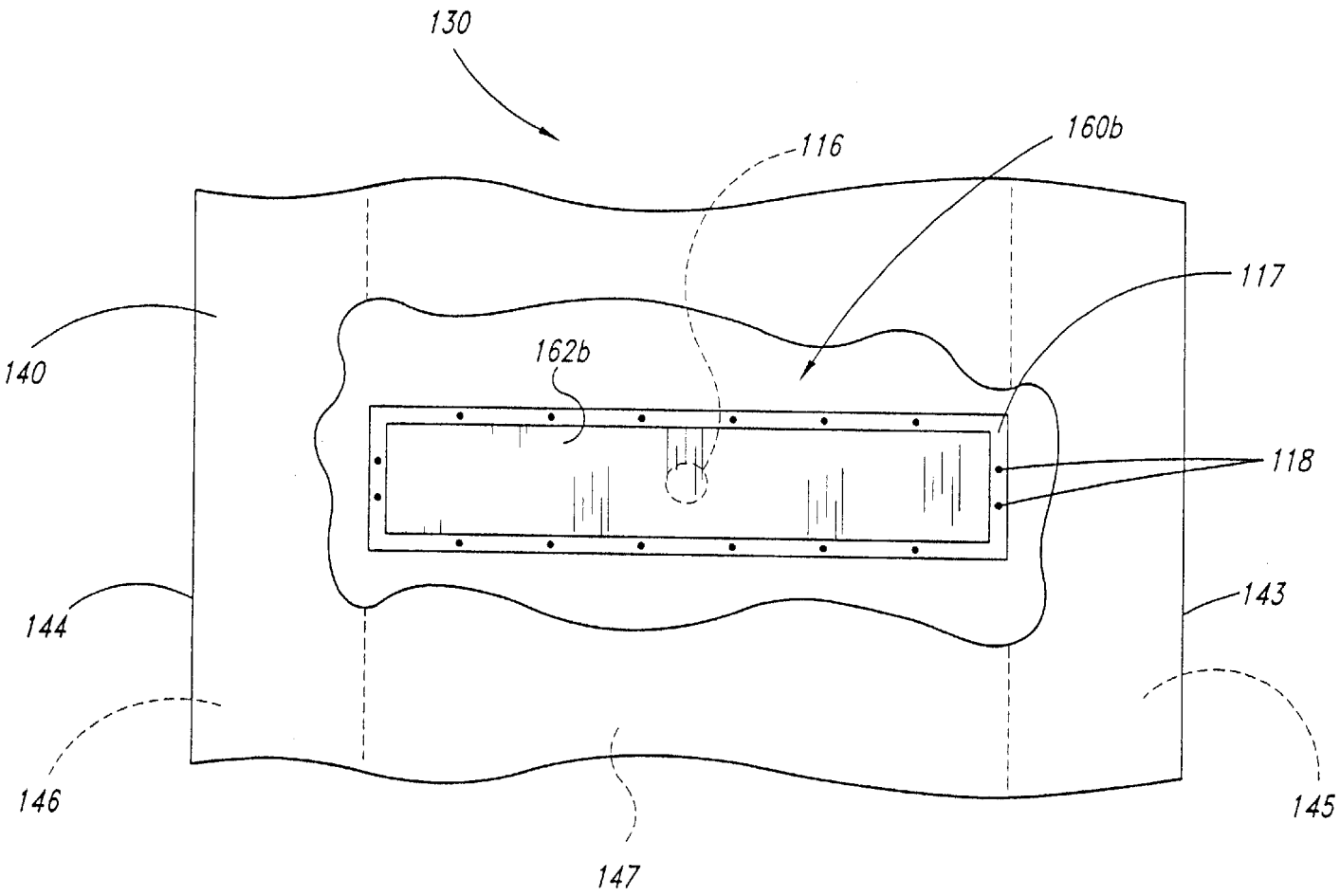
FIG. 4B is a cut-away end view of the tensioning system of FIG. 4A.

FIG. 4A is a cross-sectional side view and FIG. 4B is a partial cut-away view of a tensioning system 160*b* for the planarizing machine 100 in accordance with another embodiment of the invention. The tensioning system 160b includes a diaphragm 162*b* defining an engagement member and a fluid pump 164*b* defining an actuator. The diaphragm 162*b* is at the tensioning site 114 of the table 110. A fluid line 165 couples the fluid pump 164*b* to an orifice 116 at the tensioning site 114 in the table 110 behind the diaphragm 162*b*. The perimeter of the diaphragm 162*b* is attached to the table 110 by a clamp ring 117 and a number of fasteners 118 (e.g., screws or bolts). The diaphragm 162*b* and the clamp ring 117 are aligned with the medial region 147 of the pad 140 and extend transversely to the edges 143/144 of the pad 140.

The tensioning system 160*b* operates in a manner similar to that describe above with respect to the tensioning system 160*a* of FIGS. 3A and 3B.

The fluid pump 164*b*, for example, inflates or deflates the diaphragm 162*b* and the table 110 to move the diaphragm 162*b* against the back side of the pad 140. Because the diaphragm 162*b* is aligned with the medial region 147 of the pad 140 and does not extend into the side regions 145/146, the tensioning system 160*b* stretches the medial region 147 more than the side regions 145/146 to compensate for the slack in the medial region 147 of the pad 140.

Figure 5A:
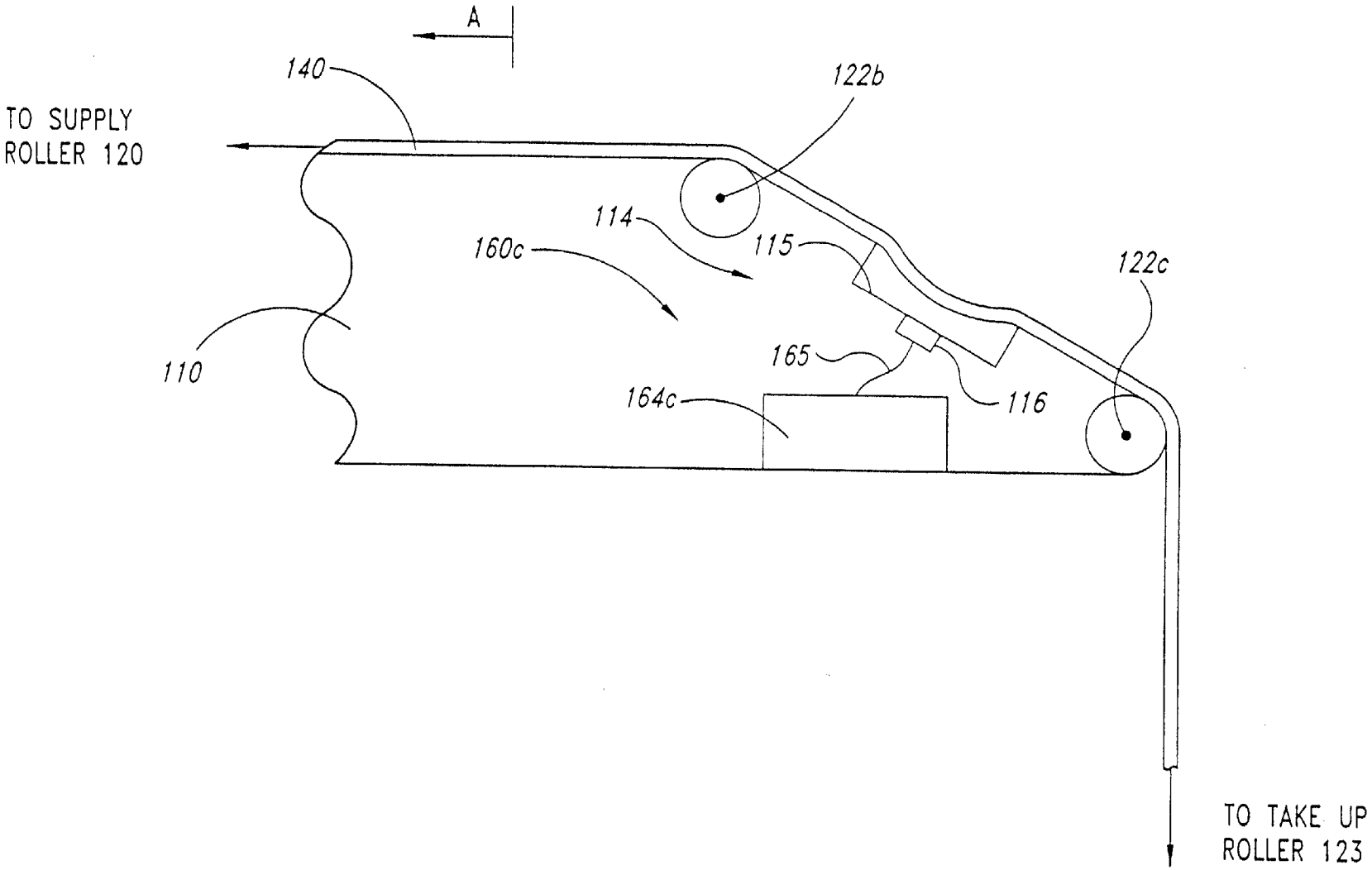
FIG. 5A is a cross-sectional side view of a tensioning system for a planarizing machine in accordance with another embodiment of the invention.
Figure 5B:
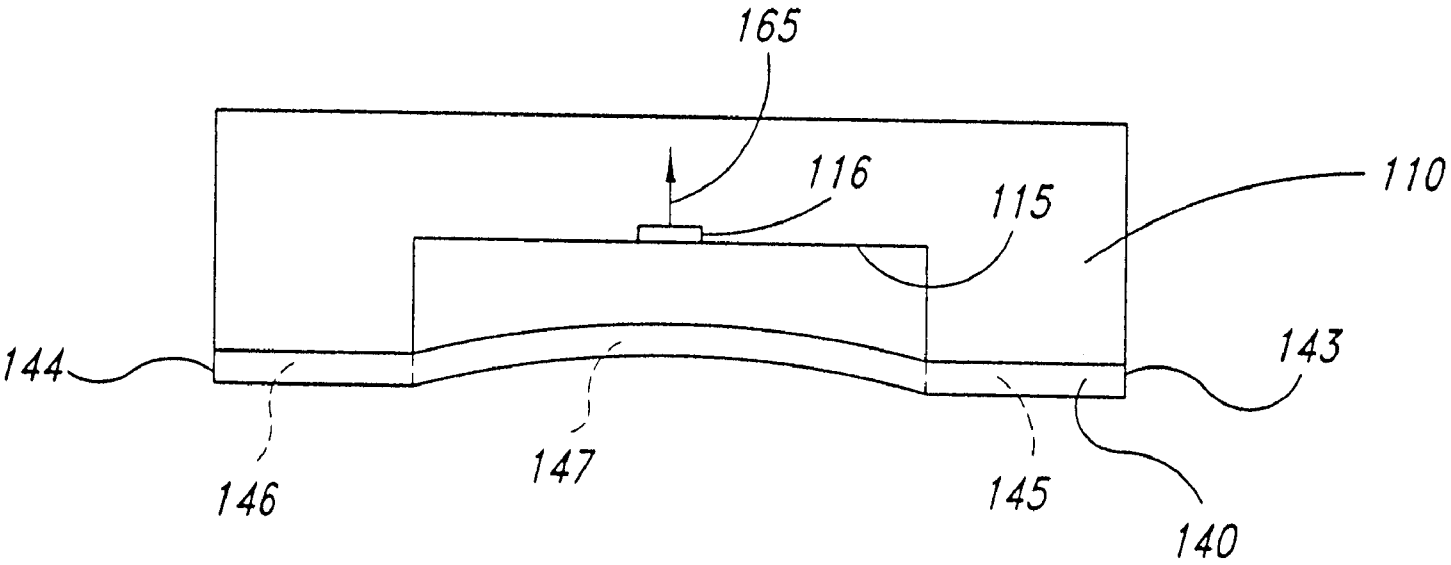
FIG. 5B is a cross-sectional top view of the tensioning system of FIG. 5A.

FIG. 5A is a cross-sectional side view and FIG. 5B is a cross-sectional top view of a tensioning system 160*c* for the planarizing machine 110 in accordance with yet another embodiment of the invention. The tensioning system 160*c* is a pneumatic stretching assembly having a fluid pump 164*c* and a fluid line 165 coupling the fluid pump 164*c* to an orifice 116 in the table 110. The orifice 116 is positioned in an elongated recess 115 at the tensioning site 114 of the table 110. The elongated recess extends transversely to the edges 143/144 in alignment with the medial region 147 of the pad 140. In operation, the fluid pump 164*c* draws a negative pressure in the elongated recess 115 to pull a section of the medial region 147 into the recess 115. The tensioning system 160*c* accordingly stretches the medial region 147 of the pad 140 more than the side regions 145/146. The negative pressure produced by the fluid pump 164*c* can be adjusted to compensate for the extent that the diameter of the used portion of the polishing pad 140 wrapped around the take-up roller 123 varies as the pad 140 wraps around the take-up roller 123.

Figure 6A:
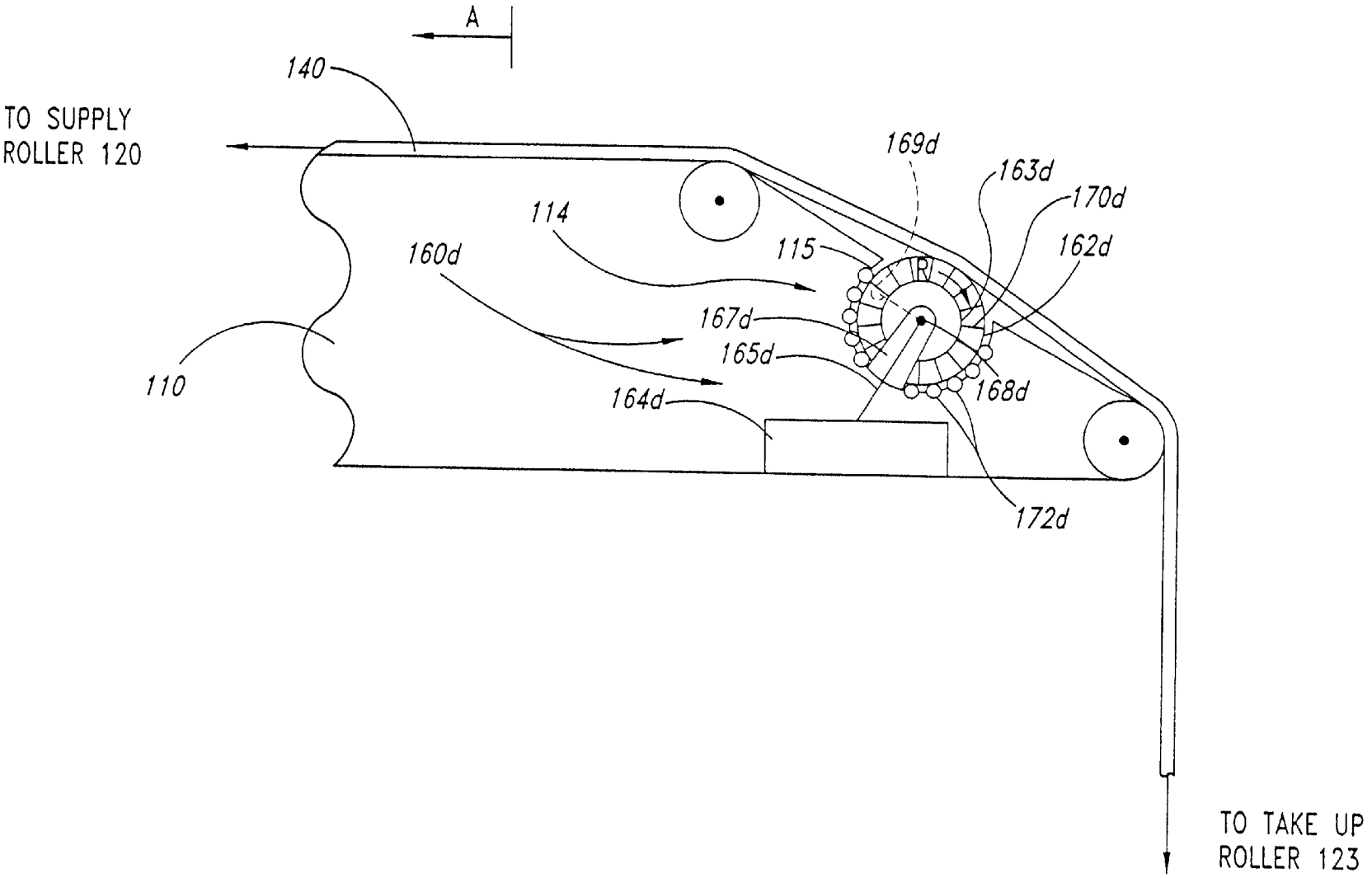
FIG. 6A is a cross-sectional side view of a tensioning system for a planarizing machine in accordance with another embodiment of the invention.
Figure 6B:
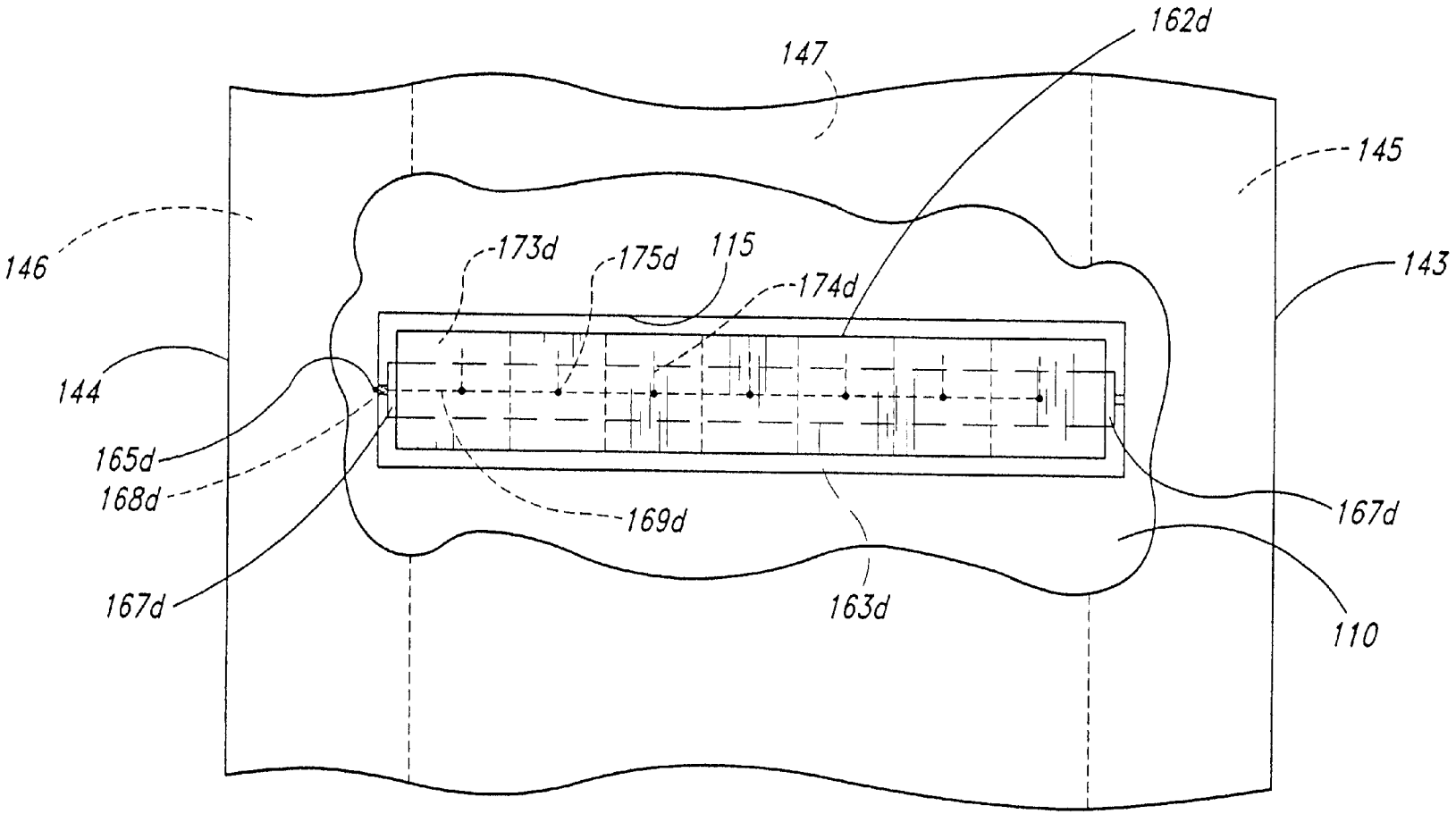
FIG. 6B is a cut-away end view of the tensioning system of FIG. 6A.

FIG. 6A is a cross-sectional side view and FIG. 6B is a cut-away end view of a tensioning system 160*d* for the planarizing machine 100 in accordance with another embodiment of the invention. The tensioning system 160*d*includes an inflatable toroidal bladder 162*d* defining an engagement member mounted to a rotating spindle 163*d*. The bladder 162*d* and the spindle 163*d* are aligned with the medial region 147 and extend transversely to the edges 143/144 of the pad 140 in an elongated cavity 115 at the tensioning site 114 on the table 110. Each end of the spindle 163*d* is rotatably attached to a support leg 167*d* projecting from the table 110 into the recess 115. The tensioning system 160*d* also includes a fluid pump 164*d* defining an actuator coupled to the toroidal bladder 162*d* by fluid lines 165*d* and 169*d*. The fluid lines 165*d* and 169*d* are rotatably coupled by a rotating fluid joint 168*d* so that the toroidal bladder 162*d* and the spindle 163*d* can rotate (arrow R) as the polishing pad 140 wraps around the take-up roller 123. Suitable rotating fluid joints 168*d* are known in the mechanical arts. In operation, the fluid pump 164*d* inflates or deflates the toroidal bladder 162*d* to adjust the pressure that the toroidal bladder 162*d* exerts against the back side of the pad 140. Accordingly, the tensioning system 160*d* is expected to perform in substantially the same manner as the tensioning systems 160*a*–160*c* described above.

The tensioning system 160*d*shown in FIGS. 6A and 6B can also have components that limit the expansion of the toroidal bladder 162*d*, or the toroidal bladder 162*d* can have several different partitions or segments to vary the expansion of the bladder 162*d* along the roller 163*d*. Referring to FIG. 6A, for example, the toroidal bladder 162*d* can include a number of internal tethers 170*d*or the table 110 can have a number of idler rollers 172*d* in the recess 115. The tethers 170*d* and the idler rollers 172*d* limit expansion of the toroidal bladder 162*d* to prevent it from ballooning in the recess 115 as it expands against the polishing pad 140. Referring to FIG. 6B, the toroidal bladder 162*d* can also have a plurality of partitions 173*d* that are separately controlled by individual fluid lines 174*d*. The individual fluid lines 174*d*, for example, can be separately controlled by remotely operated valves 175*d* to vary the fluid pressure in the partitions 173*d* so that the contour of the toroidal bladder 162*d* can be varied along the length of the roller 163*d*.

Figure 7A:
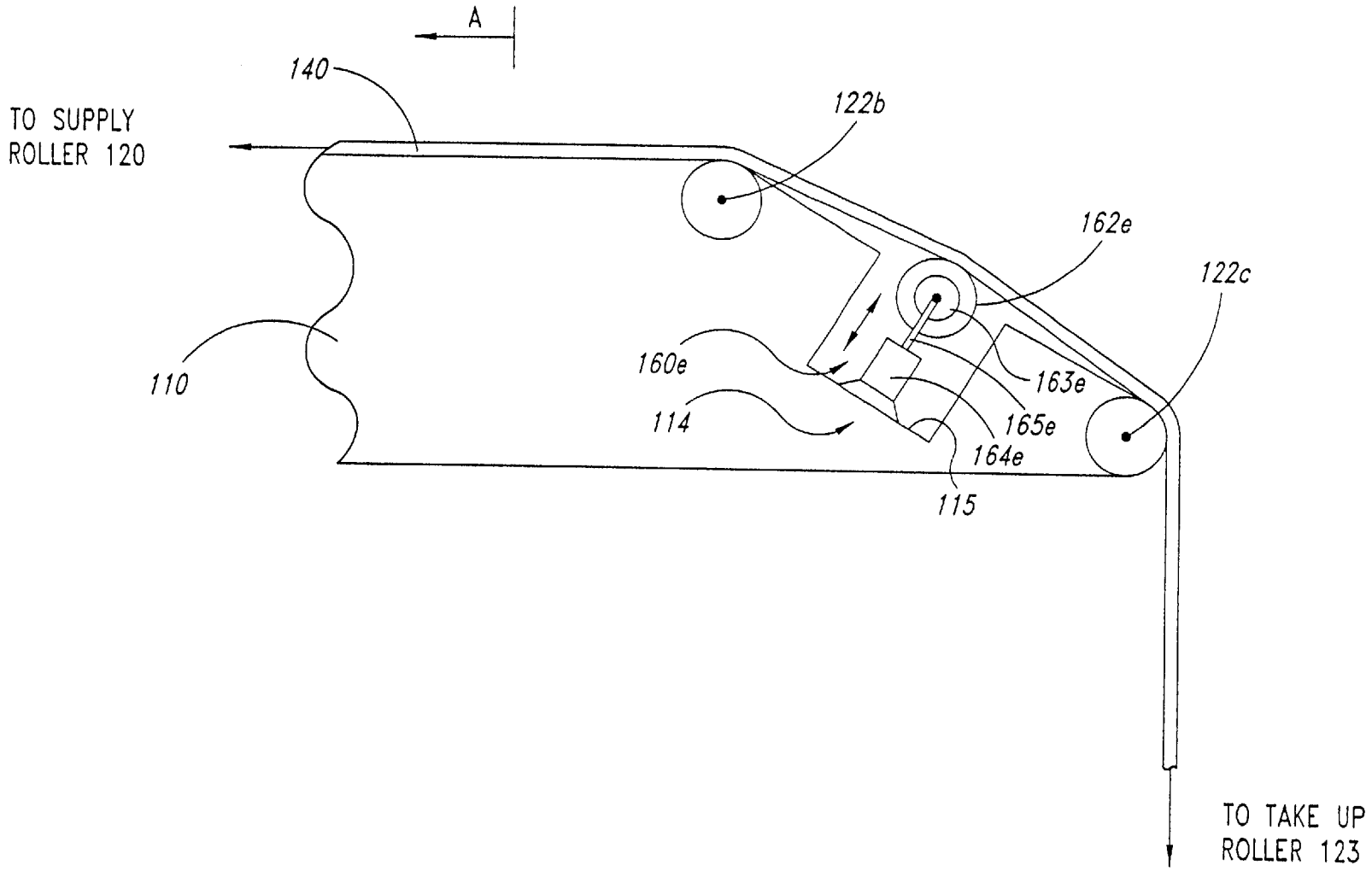
FIG. 7A is a cross-sectional side view of a tensioning system for a planarizing machine in accordance with yet another embodiment of the invention.
Figure 7B:
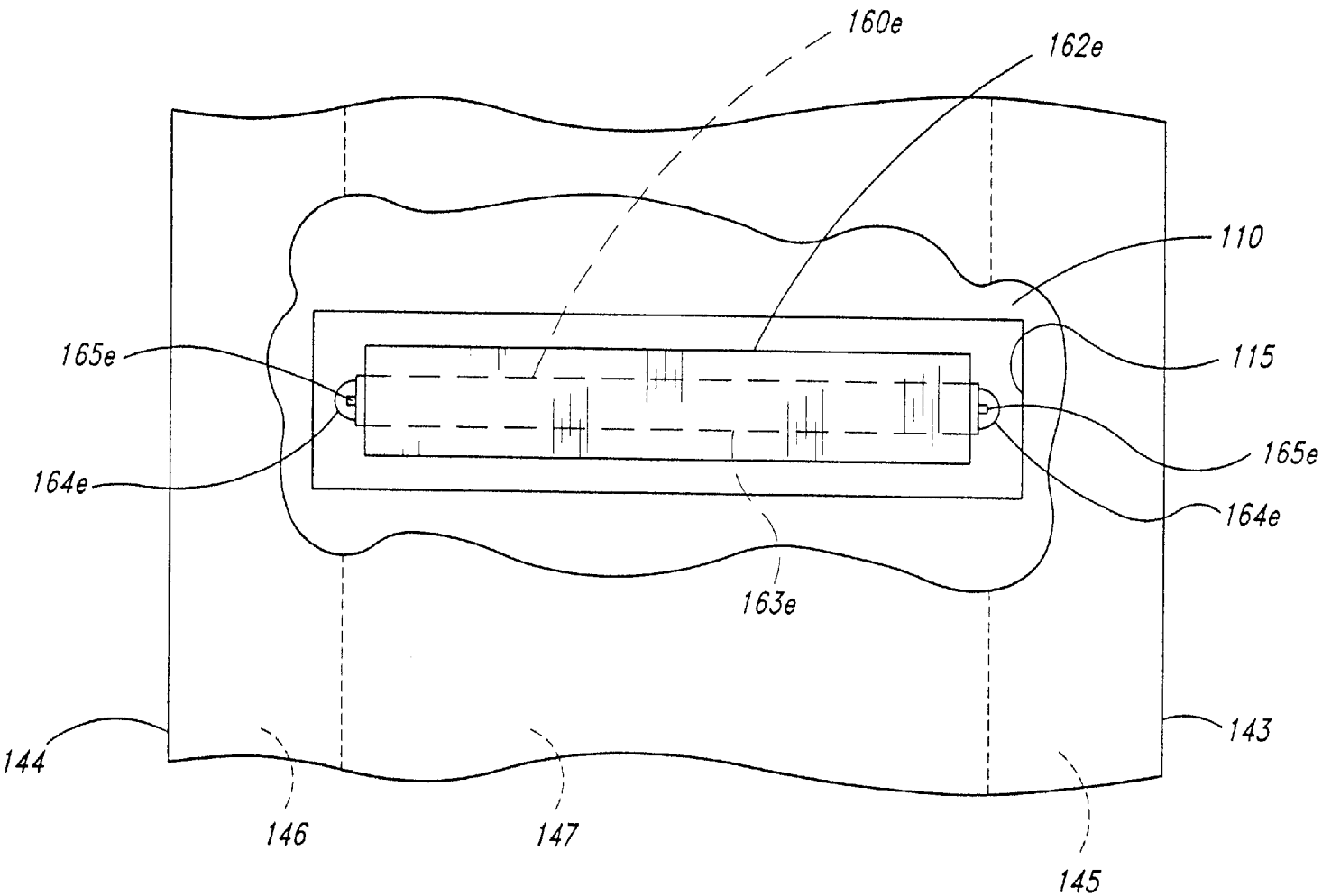
FIG. 7B is a cut-away end view of the tensioning system of FIG. 7A.

FIG. 7A is a cross-sectional side view and FIG. 7B is a cut-away end view of a tensioning system 160*e* for the planarizing machine 100 in accordance with yet another embodiment of the invention. The tensioning system 160*e* includes a rotating engagement member 162*e* attached to a spindle 163*e*. The engagement member 162*e* can be a tubular member made from compressible materials (e.g., foam or soft rubbers) or substanitially incompressible materials (e.g., high-density polymers, metals, etc.). The tensioning system 160*e* also includes first and second linear actuators 164*e* having rods 165*e* attached to opposing ends of the spindle 163*e*. The linear actuators 164*e* and the engagement member 162*e* can be positioned in an elongated recess 115 at the tensioning site 114. The linear actuators 164*e* drive the rods 165*e* to adjust the force exerted by the engagement member 162*e* against the back side of the medial region 147 of the pad 140. For example, the linear actuators 164*e* generally increase the extension of the rods 165*e* as the used portion of the polishing pad 140 wraps around the take-up roller 123 to compensate for the increase in the difference in the diameter between the side regions 145/146 and the medial region 147 across the take-up roller 123.

Figure 8A:
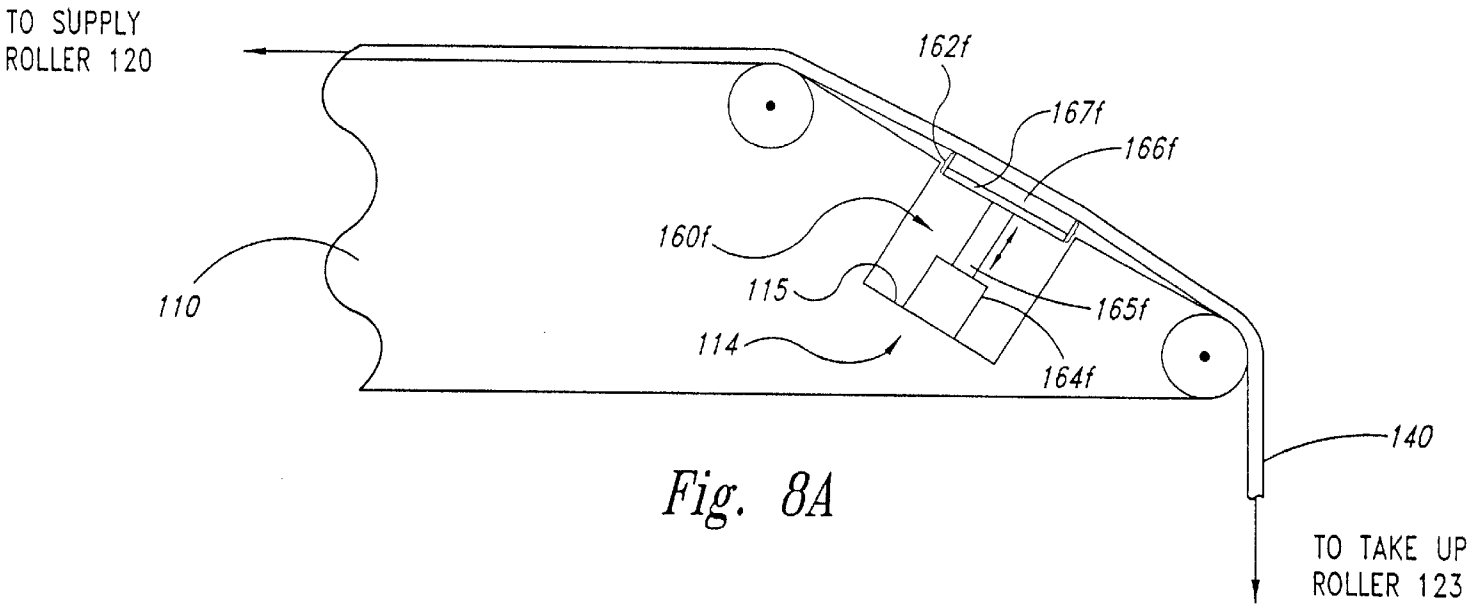
FIG. 8A is a cross-sectional side view of a tensioning system for a planarizing machine in accordance with another embodiment of the invention.
Figure 8B:
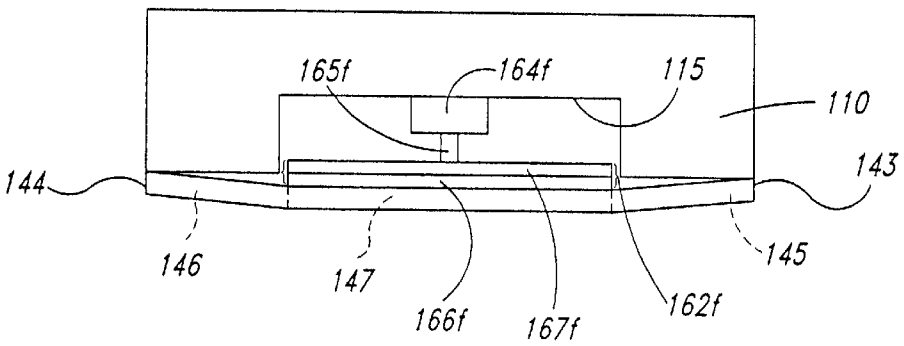
FIG. 8B is a cross-sectional top view of the tensioning system of FIG. 8A.

FIG. 8A is a cross-sectional side view and FIG. 8B is a cross-sectional top view of another tensioning system 160*f* for the planarizing machine 100 in accordance with an embodiment of the invention. The tensioning system 160*f* includes a push-plate 162*f* defining an engagement member. The push-plate 162*f* in the embodiment shown in FIGS. 8A and 8B has a compressible contact member 166*f* contacting the back side of the polishing pad 140 and a rigid back-plate 167*f* attached to the contact member 166*f*. The compressible contact member 166*f*, for example, can be a foam or rubber pad that deforms more at the side of the medial region 147 than at the center in reaction to the increasing tension in the pad 140 toward the edges 143/144. The tensioning system 160*f* also includes a linear actuator 164*f* having a rod 165*f* attached to the back-plate 167*f* The push-plate 162*f* and the actuator 164*f* are positioned in an elongated recess 115 at the tensioning site 114 on the table 110. The linear actuator 164*f* extends the rod 165*f* to push the contact member 166*f* against the back side of the medial region 147 of the polishing pad 140. The tensioning system 160*f* can operate in much the same manner as the tensioning system 160*e* described above with reference to FIGS. 7A and 7B.

Figure 9:
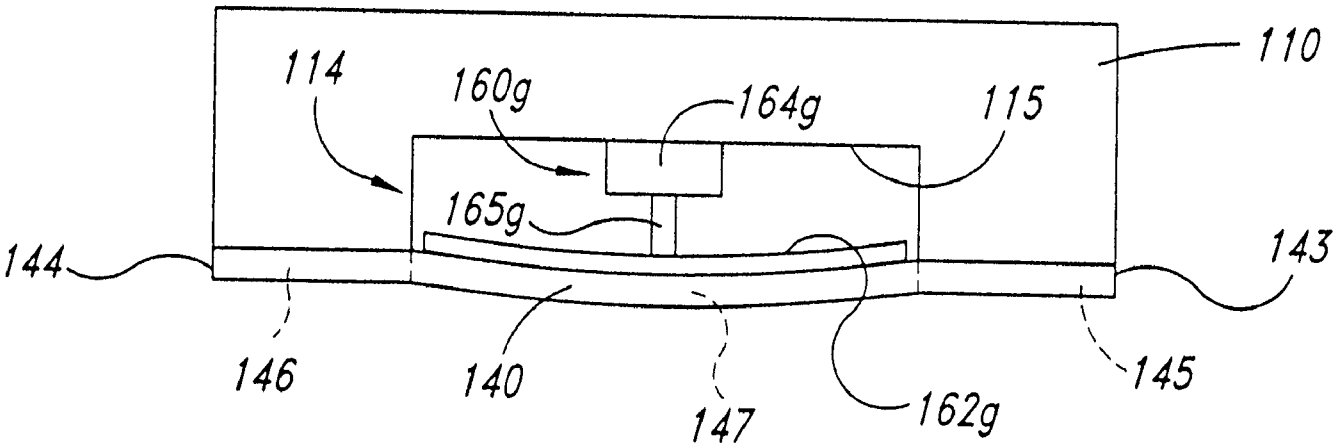
FIG. 9 is a cross-sectional top view of a tensioning system for a planarizing machine in accordance with another embodiment of the invention.

FIG. 9 is a cross-sectional top view of a tensioning system 160*g* having a push-plate 162*g* attached to a linear actuator 164*g* in an elongated recess 115 at the tensioning site 114. In this embodiment, the push-plate 162*g* can be a curved plate or a flexible plate that has an apex at approximately a midpoint of the medial region 147 of the pad 140. The curvature of the push-plate 162*g* can be shaped to be proportionate to the tension distribution across the medial region 147 of the pad 140. The linear actuator 164*g* extends or retracts a rod 165*g* to drive the push-plate 162*g* against the back side of the medial region 147 of the polishing pad.

From the foregoing it will be appreciated that, although specific embodiments of the invention have been described herein for purposes of illustration, various modifications may be made without deviating from the spirit and scope of the invention. For example, the engagement member and actuator can be other structures that push or pull the medial region 147 of the pad 140 more than the side regions 145/146. The bladders, diaphragms, rollers and push-plates can also have different shapes than those shown in FIGS. 3–9. The push-plates shown in FIGS. 8A–9, for example, can also have ball bearings at the contact surface to allow the pad 140 to slide over the push-plates as the pad moves incrementally along the pad travel path. The embodiments of the invention shown and described above with reference to FIGS. 2–9 are thus merely the best known examples of the invention for providing a more uniform tension across the width of a web-format pad to inhibit the pad from wrinkling or slipping in the planarizing zone. Accordingly, the invention is not limited except as by the appended claims.

What is claimed is:

1. A pad tensioning system for a web-format planarizing machine having a polishing pad that is advanced across a support surface of a table, comprising:

an engagement member extending transverse to first and second edges of the polishing pad to engage a medial region of the polishing pad located between first and second side regions, the first and second side regions extending along the first and second edges of the polishing pad, the engagement member being aligned with the medial region of the pad and having a length approximately equal to the width of the medial region; and an actuator connected to the engagement member, the actuator moving the engagement member transverse to the pad to press the engagement member against the medial region of the pad.

2. The pad tensioning system of claim 1 wherein:

the engagement member comprises an elongated inflatable bladder in the recess of a tensioning site located between an end of the table and a roller about which a used or unused portion of the polishing pad is wrapped when the polishing pad is driven across the support surface of the table; and the actuator comprises a fluid pump operatively coupled to the bladder, the fluid pump adjusting a fluid pressure in the bladder to selectively press the bladder against a backside of the pad.

3. The machine of claim 1 wherein:

the engagement member comprises a flexible diaphragm that engages a tensioning site located between an end of the table and a roller about which a used or unused portion of the polishing pad is wrapped when the polishing pad is driven across the support surface of the table, the tensioning site having at least one fluid port under a section of the used portion of the pad, the fluid port being aligned with the medial region of the pad; and the actuator comprises a fluid pump operatively coupled to the fluid port, the actuator adjusting a fluid pressure against the diaphragm to selectively press the diaphragm against a backside of the pad.

4. The machine of claim 1 wherein:

the engagement member comprises a push-plate that engages a tensioning site located between an end of the table and a roller about which a used or unused portion of the polishing pad is wrapped when the polishing pad is driven across the support surface of the table; and the actuator comprises a fluid piston coupled to the push-plate to selectively move the push-plate against a backside of the pad.

5. The machine of claim 1 wherein:

the engagement member comprises a push-plate that engages a tensioning site located between an end of the table and a roller about which a used or unused portion of the polishing pad is wrapped when the polishing pad is driven across the support surface of the table, the push-plate having a compressible contact member contacting the pad and a rigid back-plate attached to the contact member; and the actuator comprises a fluid piston coupled to the rigid back-plate of the push-plate to selectively move the contact member against a backside of the pad.

6. The machine of claim 1 wherein:

the engagement member comprises a push-plate that engages a tensioning site located between an end of the table and a roller about which a used or unused portion of the polishing pad is wrapped when the polishing pad is driven across the support surface of the table, the push-plate being curved to have an apex at approximately a midpoint of the medial region; and the actuator comprises a fluid piston coupled to the push-plate to selectively move the push-plate against a backside of the pad.

7. The machine of claim 1 wherein:

the engagement member comprises a flexible push-plate that engages a tensioning site located between an end of the table and a roller about which a used or unused portion of the polishing pad is wrapped when the polishing pad is driven across the support surface of the table; and the actuator comprises a fluid piston coupled to the push-plate to selectively move the push-plate against a backside of the pad.

8. The machine of claim 1 wherein:

the engagement member comprises an elongated roller located at least partially in the recess of a tensioning site located between an end of the table and a roller about which a used or unused portion of the polishing pad is wrapped when the polishing pad is driven across the support surface of the table; and the actuator comprises a fluid piston attached to the roller for moving the roller into or out of the recess to selectively press the roller against a backside of the pad.

9. The machine of claim 1 wherein:

the engagement member comprises a rigid roller and a toroidal inflatable bladder around the rigid roller that engages a tensioning site located between an end of the table and a first or second roller about which a used or unused portion of the polishing pad is wrapped when the polishing pad is driven across the support surface of the table, the rigid roller being located in a recess so that a portion of the toroidal bladder projects out of the recess and contacts a backside of the polishing pad; and the actuator comprising a fluid pump coupled to the toroidal bladder, the fluid pump adjusting a fluid pressure in the toroidal bladder to selectively press the bladder against the backside of the pad.

10. A pad tensioning system for a web-format planarizing machine having a polishing pad that is advanced across a support surface of a table, comprising:

an engagement member extending transverse to first and second edges of the polishing pad to engage a medial region of the polishing pad located between first and second side regions, the first and second side regions being adjacent to and extending along the first and second edges of the polishing pad, and the engagement member having a length less than a widthwise dimension of the polishing pad;

a pad advancing mechanism including a first roller about which an unused portion of the pad is wrapped and a second roller about which a used portion of the pad is wrapped, the second roller being below the support surface and the used portion of the pad extending downwardly from the support surface to the second roller; and an actuator coupled to the engagement member for moving the engagement member to press the engagement member against the medial region of the pad and stretch the medial region of the pad more than the first and second side regions.

11. The machine of claim 10 wherein:

the table further comprises a tensioning site between an end of the support surface and the second roller, the tensioning site having an elongated recess under a section of the used portion of the pad, the recess being aligned with the medial region of the pad and extending transverse to the edges of the pad; and the engagement member comprises an elongated inflatable bladder in the recess of the tensioning site and the actuator comprises a fluid pump operatively coupled to the bladder, the fluid pump adjusting a fluid pressure in the bladder to selectively press the bladder against a backside of the pad.

12. The machine of claim 10 wherein:

the table further comprises a tensioning site between an end of the support surface and the second roller, the tensioning site having at least one fluid port under a section of the used portion of the pad between the second end of the support region and the second roller, the fluid port being aligned with the. medial region of the pad;

the engagement member comprises a flexible diaphragm over the fluid port and the actuator comprises a fluid pump operatively coupled to the fluid port; and the actuator adjusts a fluid pressure against the diaphragm to selectively press the diaphragm against a backside of the pad.

13. The machine of claim 10 wherein:

the table further comprises a tensioning site between the second end of the support surface and the second roller, the tensioning site being aligned with the medial region of the pad;

the engagement member comprises a push-plate located at the tensioning site under a section of the used portion of the pad between the second end of the support region and the second roller; and the actuator comprises a fluid piston coupled to the push-plate to selectively move the push-plate against a backside of the pad.

14. The machine of claim 10 wherein:

the table further comprises a tensioning site between the second end of the support surface and the second roller, the tensioning site being aligned with the medial region of the pad;

the engagement member comprises a push-plate located at the tensioning site under a section of the used portion of the pad between the second end of the support region and the second roller, the push-plate having a compressible contact member contacting the pad and a rigid back-plate attached to the contact member; and the actuator comprises a fluid piston coupled to the rigid back-plate of the push-plate to selectively move the contact member against a backside of the pad.

15. The machine of claim 10 wherein:

the table further comprises a tensioning site between the second end of the support surface and the second roller, the tensioning site being aligned with the medial region of the pad;

the engagement member comprises a push-plate located at the tensioning site under a section of the used portion of the pad between the second end of the support region and the second roller, the push-plate being curved to have an apex at approximately a midpoint of the medial region; and the actuator comprises a fluid piston coupled to the push-plate to selectively move the push-plate against a backside of the pad.

16. The machine of claim 10 wherein:

the table further comprises a tensioning site between the second end of the support surface and the second roller, the tensioning site being aligned with the medial region of the pad;

the engagement member comprises a flexible push-plate at the tensioning site under a section of the used portion of the pad between the second end of the support region and the second roller; and the actuator comprises a fluid piston coupled to the push-plate to selectively move the push-plate against a backside of the pad.

17. The machine of claim 10 wherein:

the table further comprises a tensioning site between the second end of the support surface and the second roller, the tensioning site having an elongated recess under a section of the used portion of the pad, the recess being aligned with the medial region of the pad and extending transverse to the edges of the pad;

the engagement member comprises an elongated roller at least partially in the recess of the tensioning site so that a portion of the roller projects from the recess and contacts a backside of the pad; and the actuator comprises a fluid piston attached to the roller for moving the roller into or out of the recess to selectively press the roller against a backside of the pad.

18. The machine of claim 10 wherein:

the table further comprises a tensioning site between the second end of the support surface and the second roller, the tensioning site having an elongated recess under a section of the used portion of the pad, the recess being aligned with the medial region of the pad and extending transverse to the edges of the pad;

the engagement member comprises a rigid roller and a toroidal inflatable bladder around the roller, the roller being in the recess so that a portion of the toroidal bladder projects out of the recess and contacts a backside of the polishing pad; and the actuator comprises a fluid pump coupled to the toroidal bladder, the fluid pump adjusting a fluid pressure in the toroidal bladder to selectively press the bladder against the backside of the pad.

19. A pad tensioning system for a web-format planarizing machine having a polishing pad that is advanced across a support surface of a table, comprising:

a polishing pad having a medial region located between first and second side regions, the first and second side regions being adjacent to and extending along first and second edges of the polishing pad;

a pad advancing mechanism coupled to the polishing pad, the pad advancing mechanism including a first roller about which an unused portion of the pad is wrapped and a second roller about which a used portion of the pad is wrapped; and a pneumatic or mechanical stretching assembly located between an end of the table and either the first roller or the second roller, the stretching assembly configured to act against the medial region of the pad and pull or push the medial region of the pad more than first and second side regions of the pad.

20. The machine of claim 19 wherein:

the support surface of the table has a first end at one side of the planarizing zone under the unused portion of the pad and a second end at an opposing side of the planarizing zone under the used portion of the pad;

the second roller is below the support surface and the used portion of the pad extends downwardly from the second end of the support surface to the second roller;

the table further comprises a tensioning site between the second end of the support surface and the second roller, the tensioning site having an elongated recess under a section of the used portion of the pad, the recess being aligned with the medial region of the pad and extending transverse to the edges of the pad; and the stretching assembly comprises an engagement member comprising an elongated inflatable bladder in the recess of the tensioning site and an actuator comprising a fluid pump operatively coupled to the bladder, the fluid pump adjusting a fluid pressure in the bladder to selectively press the bladder against a backside of the pad.

21. The machine of claim 19 wherein:

the support surface of the table has a first end at one side of the planarizing zone under the unused portion of the pad and a second end at an opposing side of the planarizing zone under the used portion of the pad;

the second roller is below the support surface and the used portion of the pad extends downwardly from the second end of the support surface to the second roller;

the table further comprises a tensioning site between the second end of the support surface and the second roller, the tensioning site having at least one fluid port under a section of the used portion of the pad between the second end of the support region and the second roller, the fluid port being aligned with the medial region of the pad; and the stretching assembly comprises an engagement member comprising a flexible diaphragm over the fluid port and an actuator comprising a fluid pump operatively coupled to the fluid port, the actuator adjusting a fluid pressure against the diaphragm to selectively press the diaphragm against a backside of the pad.

22. The machine of claim 19 wherein:

the support surface of the table has a first end at one side of the planarizing zone under the unused portion of the pad and a second end at an opposing side of the planarizing zone under the used portion of the pad;

the second roller is below the support surface and the used portion of the pad extends downwardly from the second end of the support surface to the second roller;

the table further comprises a tensioning site between the second end of the support surfac[0085] and the second roller, the tensioning site being aligned with the medial region of the pad; and the stretching assembly comprises an engagement member including a push-plate at the tensioning site under a section of the used portion of the pad between the second end of the support region and the second roller, the stretching assembly further comprises an actuator having a fluid piston coupled to the push-plate to selectively move the push-plate against a backside of the pad.

23. The machine of claim 19 wherein:

the support surface of the table has a first end at one side of the planarizing zone under the unused portion of the pad and a second end at an opposing side of the planarizing zone under the used portion of the pad;

the second roller is below the support surface and the used portion of the pad extends downwardly from the second end of the support surface to the second roller;

the table further comprises a tensioning site between the second end of the support surface and the second roller, the tensioning site being aligned with the medial region of the pad; and the stretching assembly comprises an engagement member comprising a push-plate at the tensioning site under a section of the used portion of the pad between the second end of the support region and the second roller, the push-plate having a compressible contact member contacting the pad and a rigid back-plate attached to the contact member, the stretching assembly further comprises an actuator having a fluid piston coupled to the rigid back-plate of the push-plate to selectively move the contact member against a backside of the pad.

24. The machine of claim 19 wherein:

the support surface of the table has a first end at one side of the planarizing zone under the unused portion of the pad and a second end at an opposing side of the planarizing zone under the used portion of the pad;

the second roller is below the support surface and the used portion of the pad extends downwardly from the second end of the support surface to the second roller;

the table further comprises a tensioning site between the second end of the support surface and the second roller, the tensioning site being aligned with the medial region of the pad; and the stretching assembly comprises an engagement member comprising a push-plate at the tensioning site under a section of the used portion of the pad between the second end of the support region and the second roller, the push-plate being curved to have an apex at approximately a midpoint of the medial region, the stretching assembly further comprises an actuator having a fluid piston coupled to the push-plate to selectively move the push-plate against a backside of the pad.

25. The machine of claim 19 wherein:

the support surface of the table has a first end at one side of the planarizing zone under the unused portion of the pad and a second end at an opposing side of the planarizing zone under the used portion of the pad;

the second roller is below the support surface and the used portion of the pad extends downwardly from the second end of the support surface to the second roller;

the table further comprises a tensioning site between the second end of the support surface and the second roller, the tensioning site being aligned with the medial region of the pad; and the stretching assembly comprises an engagement member including a flexible push-plate at the tensioning site under a section of the used portion of the pad between the second end of the support region and the second roller, the stretching assembly further comprises an actuator having a fluid piston coupled to the push-plate to selectively move the push-plate against a backside of the pad.

26. The machine of claim 19 wherein:

the support surface of the table has a first end at one side of the planarizing zone under the unused portion of the pad and a second end at an opposing side of the planarizing zone under the used portion of the pad;

the second roller is below the support surface and the used portion of the pad extends downwardly from the second end of the support surface to the second roller;

the table further comprises a tensioning site between the second end of the support surface and the second roller, the tensioning site having an elongated recess under a section of the used portion of the pad, the recess being aligned with the medial region of the pad and extending transverse to the edges of the pad; and the stretching assembly comprises an engagement member including an elongated roller at least partially in the recess of the tensioning site so that a portion of the roller projects from the recess and contacts a backside of the pad, the stretching assembly further comprises an actuator having a fluid piston attached to the roller for moving the roller into or out of the recess to selectively press the roller against a backside of the pad.

27. The machine of claim 19 wherein:

the support surface of the table has a first end at one side of the planarizing zone under the unused portion of the pad and a second end at an opposing side of the planarizing zone under the used portion of the pad;

the second roller is below the support surface and the used portion of the pad extends downwardly from the second end of the support surface to the second roller;

the table further comprises a tensioning site between the second end of the support surface and the second roller, the tensioning site having an elongated recess under a section of the used portion of the pad, the recess being aligned with the medial region of the pad and extending transverse to the edges of the pad; and the stretching assembly comprises an engagement member comprising a rigid roller and a toroidal inflatable bladder around the roller, the roller being in the recess so that a portion of the toroidal bladder projects out of the recess and contacts a backside of the polishing pad, the stretching assembly further comprises an actuator having a fluid pump coupled to the toroidal bladder, the fluid pump adjusting a fluid pressure in the toroidal bladder to selectively press the bladder against the backside of the pad.

28. The machine of claim 19 wherein:

the support surface of the table has a first end at one side of the planarizing zone under the unused portion of the pad and a second end at an opposing side of the planarizing zone under the used portion of the pad;

the second roller is below the support surface and the used portion of the pad extends downwardly from the second end of the support surface to the second roller;

the table further comprises a tensioning site between the second end of the support surface and the second roller, the tensioning site having an elongated recess under a section of the used portion of the pad, the recess being aligned with the medial region of the pad and extending transverse to the edges of the pad; and the stretching assembly comprises an orifice in the recess at the tensioning site and a vacuum pump coupled to the orifice, the pump drawing a vacuum in the recess to draw a portion of the medial region of the pad into the recess and selectively stretch the medial region of the pad.

* * * * *